United States Patent [19]

Hewitt

[11] 4,200,010

[45] Apr. 29, 1980

[54] POWER-OPERATED DRILL PIPE SPINNER AND PIPE TONGS

[76] Inventor: Burton L. Hewitt, 704 Oxford Dr., Laurel, Miss. 39440

[21] Appl. No.: 931,620

[22] Filed: Aug. 7, 1978

[51] Int. Cl.[2] ..... B25B 17/00

[52] U.S. Cl. ..... 81/57.16; 81/57.34

[58] Field of Search ..... 81/57.16, 57.17, 57.2, 81/57.34; 173/164; 175/85; 166/77.5

[56] References Cited

U.S. PATENT DOCUMENTS

| | | | |
|---|---|---|---|
| 2,523,159 | 9/1950 | Stone | 81/57.11 |
| 2,862,690 | 12/1958 | Mason | 81/57.17 |
| 3,799,009 | 3/1974 | Guier | 81/57.2 |
| 3,906,820 | 9/1975 | Hauk | 81/57.17 |

*Primary Examiner*—James L. Jones, Jr.
*Attorney, Agent, or Firm*—Wigman & Cohen

[57] ABSTRACT

An improved power-operated drill pipe spinner and an improved combination of a power-spinner and conventional drill pipe tongs are disclosed. The spinner comprises a pair of hydraulically actuated gripping jaws each provided with a power-driven, endless silent chain for spinning a drill pipe section into or out of threaded engagement with a drill string and a hydraulic system for operating the same. The spinner is operatively connected to a pair of conventional pipe tongs having a lever arm and articulated jaws connected thereto. The tong jaws have an open position for receiving the drill pipe section, a latch position in which the jaws engage in non-gripping relation about the pipe and a pipe gripping position in which the jaws grippingly engage the pipe. A hydraulic ram is mechanically connected between the spinner and tongs and in hydraulic circuit with the spinning chain drive to effect automatic shifting of the tongs jaws from the latched position to the pipe gripping position.

15 Claims, 10 Drawing Figures

Fig. 6
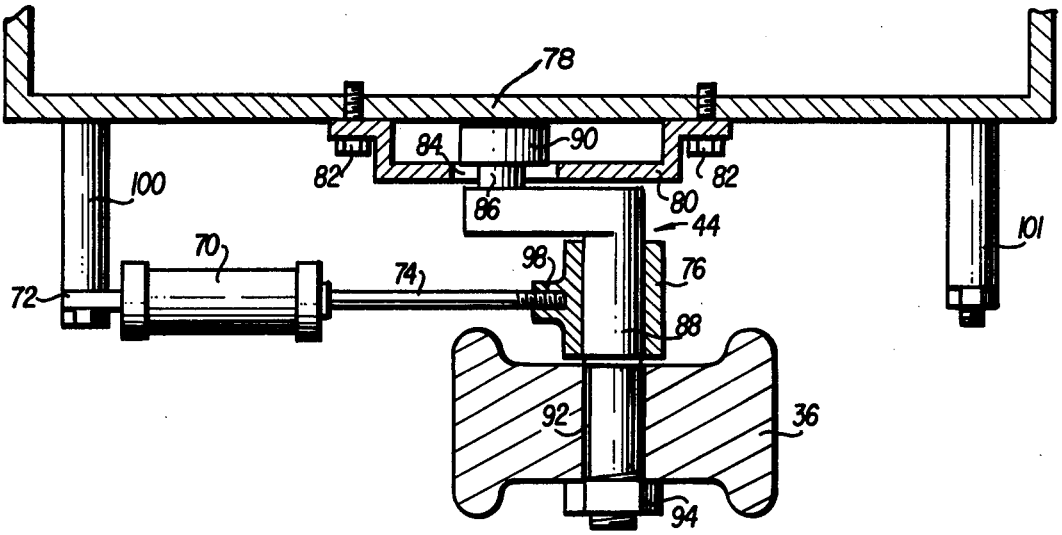
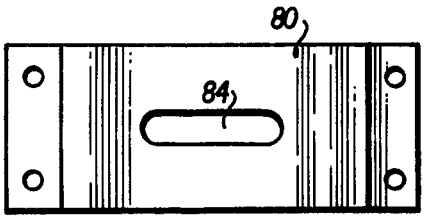
Fig. 7
Fig. 9
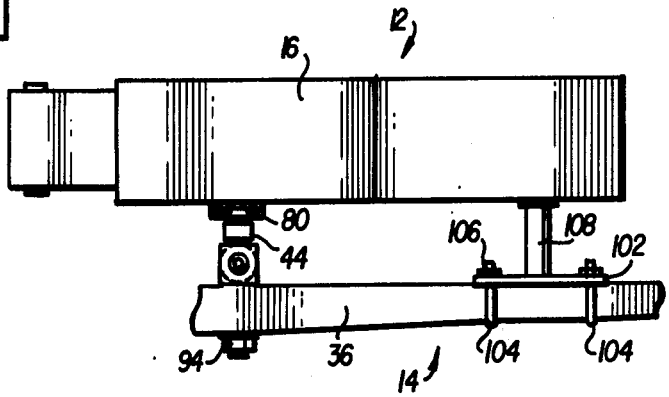
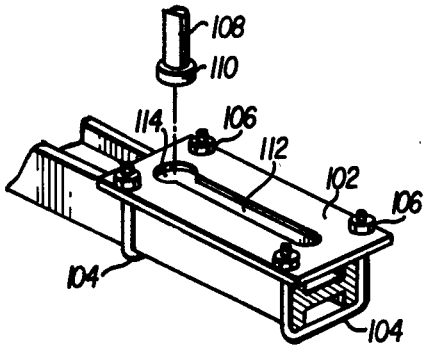
Fig. 8

POWER-OPERATED DRILL PIPE SPINNER AND PIPE TONGS

BACKGROUND OF THE INVENTION

The present invention relates to oil and gas well drilling equipment and, more particularly, to improvements in power-operated drill pipe spinners and an improved combination of a power-operated drill pipe spinner and conventional drill pipe tongs for making up and breaking out sections of drill pipe.

A search of the prior art failed to uncover any prior art reference which discloses the drill pipe spinner apparatus of the present invention. A number of prior art patents were uncovered which disclose power-operated spinners for making up and breaking out drill pipe as exemplified by the following patents:

U.S. Pat. No. 1,925,970
U.S. Pat. No. 2,649,283
U.S. Pat. No. 2,703,221
U.S. Pat. No. 2,746,329
U.S. Pat. No. 2,862,690
U.S. Pat. No. 2,871,743
U.S. Pat. No. 3,021,739
U.S. Pat. No. 3,041,901
U.S. Pat. No. 3,086,413
U.S. Pat. No. 3,799,009
U.S. Pat. No. 3,906,820

Generally, one of the main advantages of known power-operated drill pipe spinners is that the practice of using the extremely dangerous spinning line or chain for making up and breaking out drill pipe sections is eliminated, as well as the requirement for two workmen on the drilling rig floor. Despite the danger of this practice and the availability of power spinner equipment, some drilling operations are still carried out using a spinning chain because of the typically high cost of power-operated spinning equipment and, in the case of some known power spinners, the inability of the equipment to develop the torque necessary for making up or breaking out the drill string, especially when the drill pipe is dirt or oil-coated. When insufficient torque is available, it becomes necessary for the drilling floor crew to effect final make-up torque using conventional pipe tongs, which obviously results in inefficient drilling operations.

U.S. Pat. No. 3,086,413, listed above, discloses a power-driven spinner adapted to be mounted on any conventional, manually operable drill pipe tongs. According to this patent, the tongs are mounted to the power-driven spinner by means of a rather complex arrangement of parts connected to a heavy pin inserted in a bore formed in the lever arm of the tongs. After a length of tubing is spun into threaded engagement with the drill string, the jaws of the tongs are manually pivoted to a closed and locked or tube-gripping position so that torque of a desired magnitude can be applied to the tongs to effect final make-up of the tubing to the drill string. A disadvantage of this arrangement is that, after the initial spinning of the tubing to effect threaded engagement of the joint, the spinner operator or floorman must manually close and lock the tongs in gripping engagement with the tubing so as to permit final torquing. This procedure is not only inefficient in that it wastes valuable time during running-in or breaking-out of the drill string, but also requires a floorman to return to the area of the drill string during these operations to perform the required and inherently dangerous manual manipulation of the tongs.

In U. S. Pat. No. 3,906,820 mentioned above, there is disclosed a power spinner which employs a flexible drive element comprising a so-called "silent chain" for grippingly engaging the tubing. As shown and described in this patent, the term "silent chain" defines an inverted-tooth chain made up of a plurality of interleaved planar leaf links which may be constructed in accordance with American Society of Automotive Engineers Standard B29.2. The use of silent chain in a power spinner, as disclosed in this patent, enables the development of large gripping forces on the pipe to be spun. In this known power spinner apparatus, a single endless silent chain is trained about a drive sprocket, the drill pipe and two pair of sprocket wheels, each sprocket wheel pair being associated with a respective pipe gripping jaw. One disadvantage of this arrangement is that the length of the endless silent chain required for the operation of the apparatus is quite long and, in view of the high cost per foot of this chain, very expensive to replace when the same is broken or otherwise removed for repair or the like.

SUMMARY AND OBJECTS OF THE INVENTION

In view of the foregoing limitations and shortcomings of the prior art drill pipe power-spinning apparatus, as well as other disadvantages not specifically mentioned above, it should be apparent that there still exists a need in the art for a power-operated drill pipe spinner which is characterized by the combined advantages of a relatively uncomplicated design, economical construction and, furthermore, which is designed to greatly facilitate the efficient and safe making-up and breaking-out of a drill string.

It is, therefore, a primary objective of this invention to fulfill this need by providing a compact, power-operated spinner adapted to be connected to most conventional manual drill pipe tongs in a unique way so as to effect safe and automatic shifting of the tongs from a latched position to a pipe gripping position to permit application of a desired final make-up torque to the drill pipe joint without the need for further manual manipulation of the tongs and to automatically return the tongs to the latched position after make-up torque has been applied.

More particularly, it is an object of this invention to provide a power-operated spinner adapted to be connected to conventional pipe tongs, which spinner includes a pair of opposed, hydraulically-actuated pivotable jaws, each jaw having a respective relatively short endless length of "silent chain" for grippingly engaging a drill pipe, said chains being driven by a hydraulic motor via a link chain drive mechanism. The spinner also includes a hydraulic piston and cylinder interconnected with the hydraulic system of the spinner and which is arranged to effect shifting of the tongs from a latched, nongripping position to a pipe gripping position and vice versa when the spinner develops a predetermined given torque on the section of drill pipe being threadably engaged with or threadably disengaged from the drill string.

It is another object of this invention to provide a versatile power spinner for drill tubing which is adapted to operate automatically in conjunction with conventional pipe tongs for either making-up or breaking-out a drill string.

Another object of the invention is to provide an improved power spinner for drill tubing which is of extremely simple and relatively inexpensive, lightweight construction, yet is capable of developing sufficient torque to effect initial threaded engagement and torquing of a drill pipe joint.

Yet another object of this invention is to provide a power-operated spinner apparatus for making up a drill string, the simple and essentially "hands-off" operation of which is particularly safe for drilling floor personnel.

Another object of this invention is to provide a power spinner which may be readily adapted for remote and substantially automatic power operation.

It is another object of this invention to provide a power-operated spinner for drill tubing, the essential components of which are readily accessible for replacement, repair or the like.

Still another object of the invention is to provide a power-operated spinner which utilizes a pair of opposed, relatively short, endless "silent chains" arranged in such a way as to grippingly engage a maximum circumferential area of the drill tubing to effect spinning thereof.

Briefly described, the aforementioned objects are accomplished according to the invention by providing a power-operated spinner having a spinner housing or frame for supporting a hydraulic system including a hydraulic motor, controls, valving, hydraulic lines, power rams and the like. A pair of arcuate jaws are pivotally mounted to the spinner housing in opposed relation to each other so as to be simultaneously pivotable from an outwardly pivoted, open, pipe-receiving position to an inwardly pivoted, closed and gripping position about the drill pipe to be spun. Hydraulic pistons and cylinders are provided for each jaw for pivoting the same between their open and closed positions. Each jaw rotatably supports a spaced pair of sprockets comprising a inboard driven sprocket and an outboard idler sprocket. A pair of advantageously short, endless silent chains are trained about a respective pair of sprockets. If desired, the idler sprockets may be mounted, for example, on eccentric means for shifting the outboard sprocket axes to one of several positions on a respective jaw to accommodate various diameters of drill tubing. The drive sprockets are both interconnected by means of a link-type drive chain to the shaft of a reversible hydraulic motor mounted to the spinner housing. The spinner housing is provided on its underside with means for supporting a set of conventional pipe tongs and for operatively interconnecting the spinner with the tongs. Such means include a hydraulic piston and cylinder hydraulically connected in circuit with the hydraulic system of the spinner and mechanically interconnected to the pipe tongs so as to effect automatic shifting of the tongs from the latch position to the pipe gripping position when hydraulic pressure in the system reaches a predetermined magnitude corresponding substantially to the maximum torque developed on the drill pipe section by the jaws of the spinner. Means are also provided for automatically returning the tongs to the latched position after final make-up torque has been applied to the drill pipe joint.

The spinner is adapted to be connected to most conventional tubing tongs, such as, for example, those manufactured by the B. J. Hughes Company. Exemplary types of tubing tongs which may be adapted for use with the present invention are disclosed in U.S. Pat. Nos. 2,278,439; 2,347,698; 2,392,931; and 2,310,246 among many others.

It is also within the contemplation of the present invention to employ the spinner/pipe tong combination disclosed herein in break-out operations when pulling a drill string from the borehole. In such operations, conventional break-out tongs are interconnected with the spinner in substantially the same manner as the make-up tongs and the spinner is operated first to automatically shift the break-out tongs from the latched position to the gripping position to permit breaking of the joint by the cathead. After the break-out tongs are returned to the latched position, the spinner is operated in reverse to threadably disengage the drill pipe from the drill string.

With these and other objects, advantages and features of the invention that may become hereinafter apparent, the nature of the invention may be more clearly understood by reference to the following detailed description thereof, the appended claims and to the several views illustrated in the attached drawings, wherein:

BRIEF DESCRIPTION OF THE DRAWINGS

FIG. 6 is a view, partly in section, illustrating the operative connection between the drill pipe spinner and pipe tongs of the present invention;

FIG. 7 shows a detail of the connection of FIG. 6;

FIG. 8 is a fragmentary perspective view illustrating the rearward connection between the drill pipe spinner and pipe tongs of the present invention; and FIG. 9 is a fragmentary side view of the connections between the drill pipe spinner and pipe tongs of the invention.

DETAILED DESCRIPTION OF A PREFERRED EMBODIMENT

Figure 1:
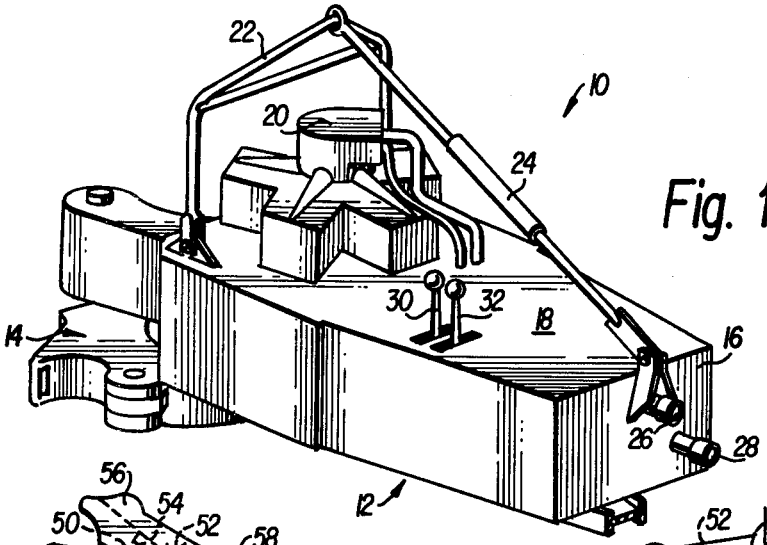
FIG. 1 is a perspective view from a rearwardly direction of the drill pipe spinner and pipe tong combination of the present invention.

Referring now in detail to the drawings, there is shown in FIG. 1 the combination drill pipe spinner and pipe tong apparatus of the invention which is designated generally by reference numeral 10. The apparatus 10 includes a drill pipe spinner 12, beneath which conventional drill pipe tongs 14 are suspended in a cooperative relation therewith and in a novel manner to be hereinafter described. The spinner 12 comprises a rigid housing or frame 16, preferably of welded steel construction, having a top plate 18 to which is rigidly connected a conventional reversible hydraulic motor 20 at a point adjacent the forward end of the housing.

The apparatus 10 is adapted to be supported above the floor of a drilling rig by means of a three-arm suspension bracket 22 detachably secured to the housing 16 and a hangar/wire line assembly which is conventional and, therefore, is not particularly illustrated. The suspension bracket 22 includes a turnbuckle 24 or the like in the rearwardly directed arm to permit adjustment of the longitudinal axis of the spinner to a substantially horizontal position. Within the housing enclosure 16 there is located a hydraulic system for the apparatus, which hydraulic system is shown and described in detail hereinbelow in connection with FIG. 5.

Conventional quick-disconnect hydraulic couplings 26, 28 are provided at the rear of the housing 16 for connection via hydraulic lines (not shown) to a remote source of hydraulic fluid, such as a hydraulic pump powered by a prime mover. Extending through top plate 18 of the housing are a pair of manual operating levers 30, 32 for control of the hydraulic system shown in FIG. 5.

Figure 2A:
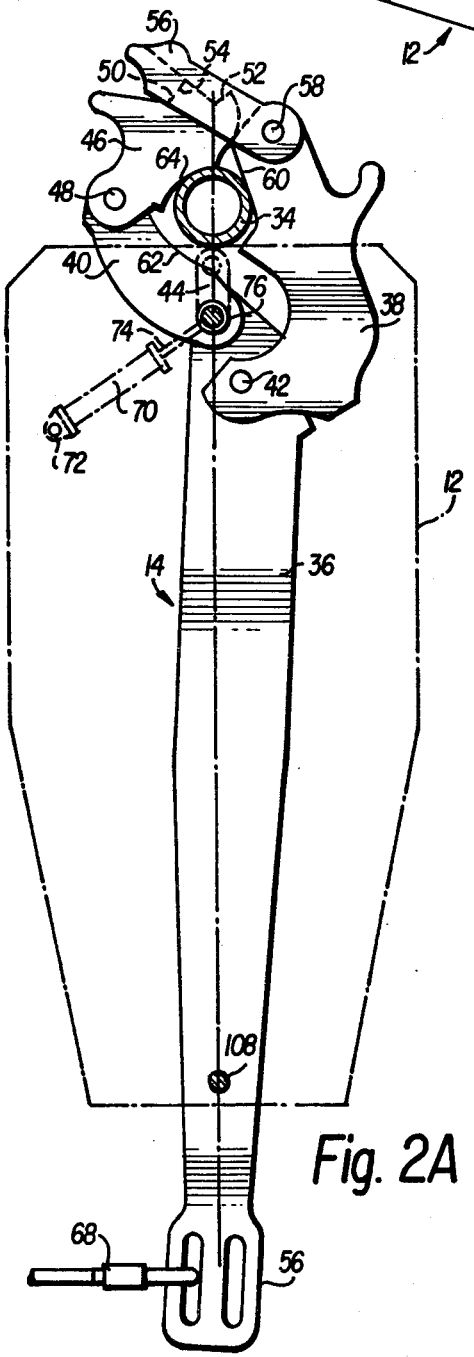
FIGS. 2A and 2B are top plan views showing the pipe tongs of the spinner/tong combination of the invention in the latched and gripping positions, respectively.
Figure 2B:
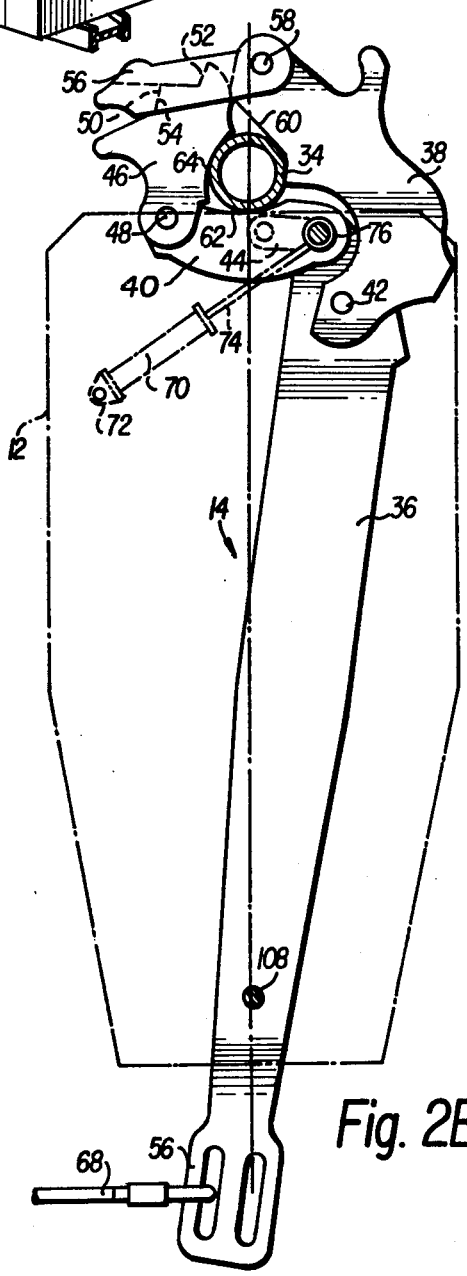

In the top views of the apparatus in FIGS. 2A and 2B, the spinner 12 is shown only partly and in phantom lines to more clearly illustrate the manner in which the jaws of the pipe tongs 14 are arranged about a drill pipe 34 and are articulated between the latched, but non-pipe gripping position shown in FIG. 2A and the pipe gripping position shown in FIG. 2B. For the purposes of this disclosure, the illustrated tongs 14 are substantially the same as the tongs described in U.S. Pat. No. 2,466,032, the disclosure of which is incorporated herein by reference. It is to be clearly understood, however, that the present invention contemplates that many other drill pipe tongs, including both make-up and break-out tongs, are equally suitable and adaptable for use in the present invention and that the invention is not intended to be limited by the disclosure herein of a specific pipe tong construction.

The tongs 14 comprise a lever 36 to the forward end of which a pair of jaws 38, 40 are pivotally connected for swinging movement about spaced apart, parallel axes, the former by means of pivot pin 42 and the latter by means of a special adapter pin 44 which replaces the conventional pivot pin which otherwise would pivotally secure jaw 40 to lever 36. A latch lug jaw 46 is pivotally connected to the outer end of jaw 40 by a pivot pin 48 and is provided with a pair of latching lugs 50, 52 adapted to be selectively engaged by a latching surface 54 on a latch 56 which is pivotally connected by pivot pin 58 to the outer end of jaw 38. The jaws 38, 40, 46 are provided with pipe gripping surfaces 60, 62, 64, respectively, which are adapted to engage drill pipe of a wide range of sizes. By the substitution of latch lug jaws 46 of varying length, the tongs may accommodate a wide range of drill pipe diameters.

At the opposite end of the lever 36, there is provided a clevis fitting 56 for connecting tong line 68, the non-illustrated free end of which is wrapped about a conventional rotating cathead on the drawworks of the rig. After the tongs 14 have been automatically set in the pipe gripping position according to the invention, a tensile force applied to line 68 by the cathead applies the final make-up torque to the drill pipe 34. Also shown in phantom in FIGS. 2A and 2B is a hydraulic piston and cylinder or ram 70, the cylinder end of which is provided with a pivot lug 72 for pivotally connecting the ram to the bottom of the spinner housing 16. Piston rod 74 is rigidly affixed to a bearing sleeve 76 rotatably mounted on the special adapter pin 44.

Referring now to FIG. 6, the operative connection between the spinner 12 and tongs 14 will be described. As shown, the spinner housing includes a bottom plate 78 to which is affixed a somewhat U-shaped, rectangular mounting plate 80 by means of bolts 82. Mounting plate 80 is provided with a transverse slot 84, as best seen in FIG. 7. Special adapter pin 44 is formed as a crank-like element with offset pins 86, 88. Pin 86 is slidably and rotatably retained in slot 84 of plate 80 by means of a broadened head 90. The lower portion of pin 88 extends through a bore 92 in the tong lever 36 and a lock nut 94 is threaded onto the threaded end of pin 88 to support the tongs in spaced relation beneath the spinner housing. Bearing sleeve 76 is rotatably mounted to the upper portion of pin 88 and has a radial boss 98 which is provided with a threaded bore for receiving the threaded end of piston rod 74. The pivot lug 72 attached to the cylinder end of ram 70 is pivotally mounted to the housing by a stand-off pin 100 welded or otherwise rigidly secured to the bottom plate 78. A further stand-off pin 101 is provided on the bottom plate 78 opposite pin 100 for use with break-out tongs.

FIGS. 8 and 9 show the manner in which the rearward or free end of the tong lever 36 is mounted to the housing in relation to the mounting shown in FIG. 6. A rectangular slotted plate 102 is adjustably affixed to the lever 36 by means of U-bolts 104 and nuts 106. A mounting pin 108 is suitably affixed to the bottom plate 78 adjacent the outer end of the housing and is provided with a broadened head 110 which engages in a slot 112 in plate 102. Slot 112 has an enlarged opening 114 at one end thereof for receiving head 110. After insertion of head 110 in opening 114, plate 102 is positioned along the axis of the lever 36 and secured thereto so as to prevent disengagement of the pin from the slot during relative movement between the tong lever and the drill pipe spinner.

It will be appreciated that the specific design of the several parts forming the interconnection means between the drill pipe spinner and tongs may vary depending on the particular design of drill pipe make-up or break-out tongs employed with the spinner. In addition, it will be seen that with the above-described interconnection arrangement the make-up tongs may be quickly disconnected from the spinner and replaced, for example, with break-out tongs.

Figure 3:
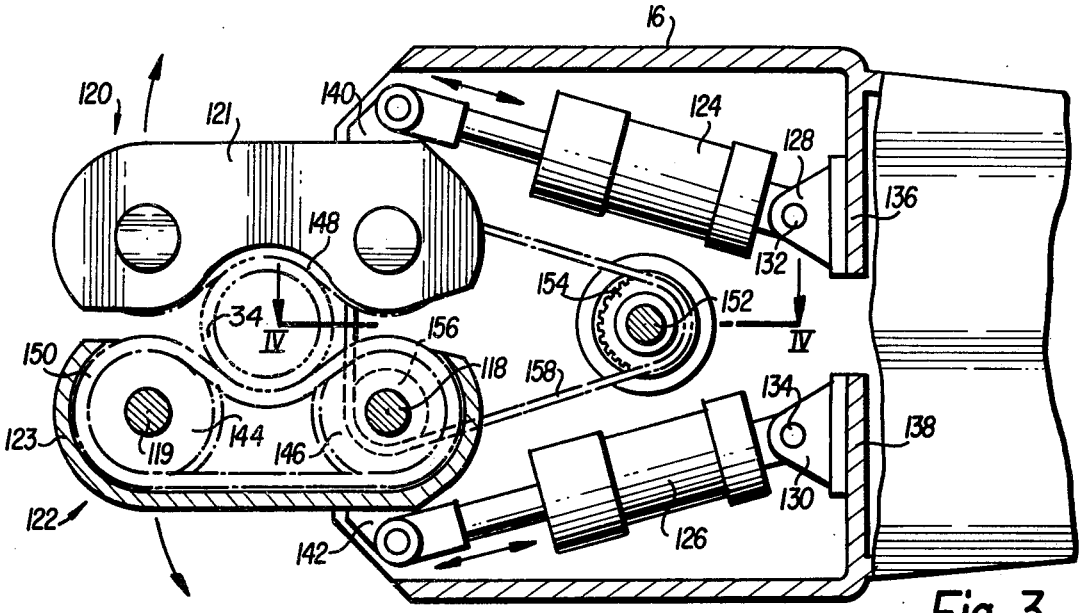
FIG. 3 is a fragmentary top view, partly in section, showing details of the drill pipe spinner of the invention.

FIG. 3 illustrates the arrangement of the spinner drive and spinner jaw pivoting mechanism. Pivotally mounted on pins 118 (only one shown) and extending from the forward open end of the housing 16 of the spinner are a pair of opposed jaws 120, 122, each including a jaw housing 121, 123. Within the forward part of the housing enclosure, a pair of hydraulic rams 124, 126 are pivotally mounted by means of brackets 128, 130 and pins 132, 134 between housing walls 136, 138 and lever arms 140, 142 of the respective spinner jaws. Rams 124, 126 each comprise a double-acting hydraulic piston and cylinder unit for pivoting the spinner jaws between an open position for receiving drill pipe 34 and the closed, pipe gripping position illustrated in FIG. 3. Each jaw 120, 122 is provided with a pair of spaced sprockets 144, 146 (only one pair shown) rotatably mounted on pins 118 and pins 119 suitably affixed to the jaw housings 121 and 123. If desired, pins 119 may be mounted to the jaw housings 121 and 123 by eccentrics to thereby adapt the spinner to various drill pipe diameters.

Trained about each pair of sprockets 144, 146 is an endless silent chain 148, 150 of the type mentioned above. As FIG. 3 shows, the length of each chain 148, 150 is greater than the path of travel about the sprockets as defined by the peripheral surfaces of the sprockets engaged by the chain and the tangents between the sprockets. This normally slack condition of the chains is provided to permit the chain to grippingly engage the drill pipe 34 over a substantial arcuate portion of the drill pipe periphery, i.e., two oppositely disposed, arcuate portions of the least 90 degrees or a total of 180 degrees or more of gripping surface.

Figure 4:
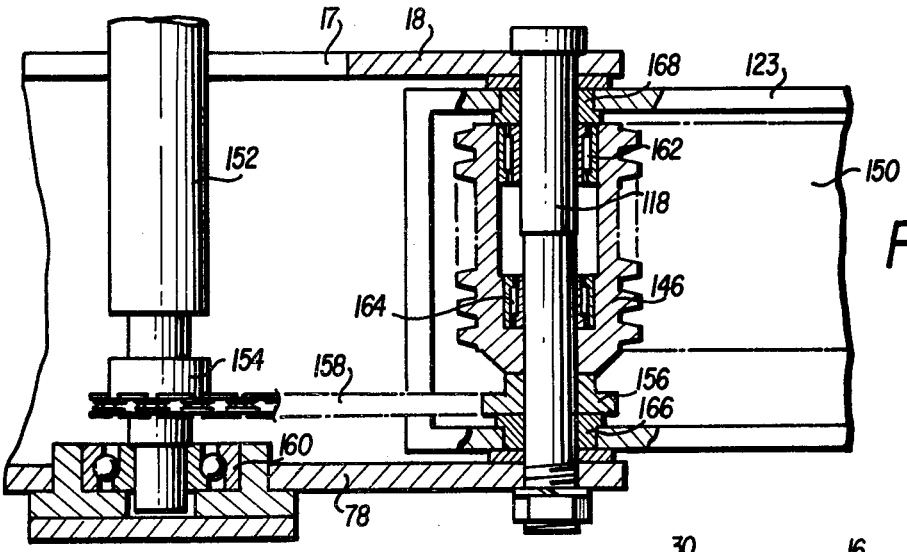
FIG. 4 is an enlarged cross-section view of the drill pipe spinner driving connections taken along line IV—IV of FIG. 3.

Referring now also to FIG. 4, the drive shaft 152 of the hydraulic motor 20 mounted on the top plate of the spinner housing 16 extends downwardly through an opening 17 in the top plate to a point midway between the sprocket pins 118 and spaced rearwardly therefrom, that is, to the right as seen in FIG. 3. By this arrangement, as viewed in FIG. 3, the axes of the shaft 152 and pins 118 define the apices of a triangle. Shaft 152 and pins 118 are provided with link chain sprockets 154 and 156. Sprocket 154 is non-rotatably keyed or splined to shaft 152 by suitable means and the sprockets 156 are welded, integrally formed with or otherwise rigidly secured to the lower ends of the silent chain sprockets 146. A drive chain 158 of the link-type is trained about the sprockets 154, 156 so that silent chain sprockets 146 comprise the driven sprockets whereas silent chain sprockets 144 comprise idler sprockets.

As FIG. 4 shows, the downwardly projecting end of motor shaft 152 is received in a roller bearing 160 fixedly mounted in the bottom plate 78 of the spinner housing. Each of the sprockets 144, 146 is rotatably supported on its respective pin 118 or 119 by a pair of axially spaced roller bearing assemblies 162, 164 between a pair of bushings 166, 168 upon the latter of which the jaw housings 121, 123 are pivotally supported on the pins 118.

Figure 5:
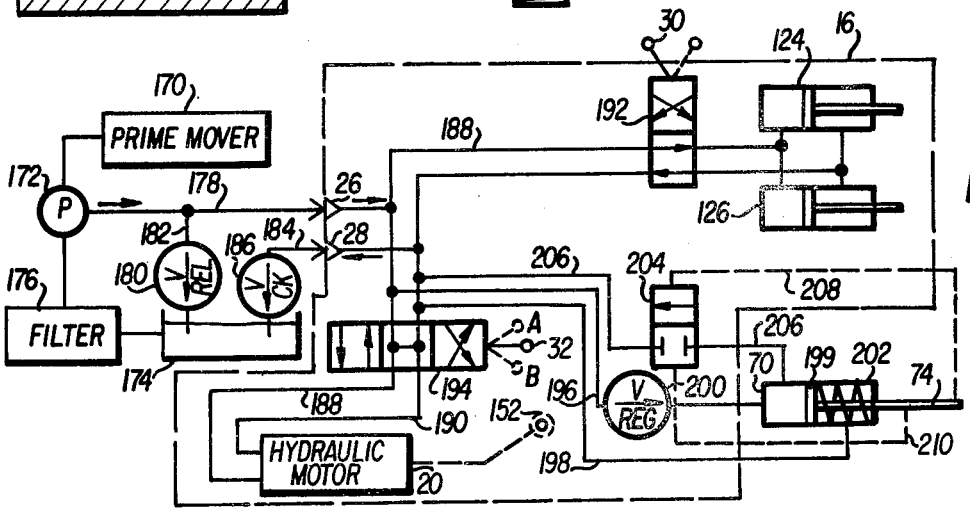
FIG. 5 is a schematic diagram of the hydraulic system of the present invention.

FIG. 5 illustrates the hydraulic circuit for the apparatus of the invention. A prime mover 170, such as an internal combustion engine or the like, is drivingly connected to a hydraulic pump 172 which draws a hydraulic fluid medium from the reservoir 174 via filter 176 and discharges it into pressurized fluid supply conduit 178. A relief valve 180 connected in conduit 182 discharges overpressure fluid from supply conduit 178 back into reservoir 174. Pressurized fluid return conduit 184 is connected by a check valve 186 also with the reservoir. The pressurized fluid supply and return conduits 178, 184 are connected with respective quick-connect couplings 26, 28 to the hydraulic circuit located within the spinner housing 16.

Pressurized fluid is supplied and discharged via conduits 188, 190 to and from a two-way valve 192 which is manually controlled by means of a manual lever 30. Valve 192 supplies and discharges pressurized fluid to and from the opposite sides of the pistons of the double-acting hydraulic rams 124, 126 of the spinner jaws for selectively opening and closing the same about the drill pipe. Pressurized fluid is also supplied to a three-way valve 194 controlled by manual lever 32. In the positions of the lever 32 designated A and B, pressurized fluid is supplied to hydraulic motor 20 to drive its shaft 152 in clockwise and counterclockwise directions so as to control the direction of spin of the drill pipe. In the midposition of the valve 194, the lever 32 is in a neutral position and the valve 194 shunts fluid between the conduits 188, 190 so that pressurized fluid is recirculated and does not operate motor 20.

Bypass supply and exhaust conduits 196, 198, respectively, are connected to the hydraulic ram 70 on opposite sides of its piston 199. An adjustable pressure regulator valve 200 is arranged in supply conduit 196 and is adjusted to admit pressurized fluid into the cylinder or ram 70 when the pressure in conduit 196 reaches a predetermined value corresponding to the maximum torque developed on the drill pipe by the spinner chains. When pressurized fluid is admitted to such cylinder, piston rod 74 is urged outwardly to its extended position against the force of a spring 202 arranged on the right-hand side of piston 199. A two-position valve 204 is connected in an exhaust conduit 206 between the discharge conduit 190 and the cylinder of ram 70 on the left-hand side of piston 199. Valve 204 is closed in the retracted position of piston 74 by means of a mechanical actuator and linkage 210 and is operated to the open position by a mechanical actuator and linkage 208, both of which linkages are coupled to the piston rod 74 and are actuated by the movement of the piston rod between its retracted and extended positions. When valve 204 is opened, pressurized fluid on the left-hand side of piston 199 is exhausted to the reservoir 174 through conduits 206, 190, and 184.

Operation of the spinner/tong combination of the invention proceeds by swinging the apparatus from its suspension assembly, with the spinner and tong jaws in their open, pipe-receiving positions, into a position about a length of drill pipe to be threadably engaged with the drill string. The tong jaws are then manually shifted to the latched position shown in FIG. 2A and latch 56 is engaged with an appropriate latch lug 50 or 52. The hydraulic system is then energized and pressurized fluid is supplied to conduits 188, 190. Lever 32 is set in its neutral position to shunt fluid between conduits 188, 190 and lever 30 is operated to extend the piston rods of rams 124, 126 and close the spinner jaws 120, 122 about the drill pipe. Thereafter, lever 32 is shifted to position B to supply hydraulic fluid to motor 20 and thereby rotate shaft 152 in a counterclockwise direction. Silent chains 148, 150 thus rotate drill pipe 34 clockwise to effect initial threaded engagement of the drill pipe to the drill string at a torque of about 1100 ft. lbs. When such initial engagement is completed, the drill pipe resists further rotational movement and the pressure of hydraulic fluid in conduit 190 increases. When the pressure reaches the preset pressure of pressure regulator valve 200, such valve opens and admits pressure to the cylinder of ram 70 to extend piston rod 74 and thereby automatically shift the pipe tongs to the pipe gripping position shown in FIG. 2B.

A slight tension is maintained on tong line 68 by the cathead during the time the tongs are shifted to the FIG. 2B position and mechanical linkage 208 operates two position valve 204 to the open position. Lever 32 is then shifted to its neutral position to stop rotation of the spinner chains 148, 150. Final make-up torque of between 1450–1600 ft. lbs. is then applied to the drill pipe by pulling the tong lever 36 clockwise with the cathead and tong line 68. When tension is released on tong line 68, since valve 204 has been shifted to the open position by linkage 208 spring 202 urges piston 199 leftwardly discharging fluid in ram 70 via conduit 206. Piston rod 74 also moves to its retracted position to thereby automatically return the tongs to the latched position of FIG. 2A and again close valve 204 via mechanical linkage 210. Lever 30 is operated to retract the piston rods of rams 124, 126 and open the spinner jaws 120, 122. The tong jaws are then manually unlatched and the apparatus is swung away from the drill pipe.

Altough only a preferred embodiment is specifically illustrated and described herein, it will be appreciated that many modifications and variations of the present invention are possible in light of the above teachings and within the purview of the appended claims without departing from the spirit and intended scope of the invention.

What I claim is:

1. In a power-operated spinner for engaging and spinning a section of drill pipe into threaded engagement with a drill string to a given torque and including drill pipe tongs, means mounting said tongs to said spinner, said tongs including a lever arm and pivotably related jaws connected thereto for engaging said drill pipe, said jaws being shiftable from an open position for initially receiving said drill pipe to a latched position in which said jaws are interlocked with each other in non-gripping relation about said pipe and thence to a gripping position in which said jaws grippingly engage said pipe, the improvement comprising means operatively connected between said spinner and tongs for automatically shifting said jaws from said latched position to said gripping position when said spinner has spun said drill pipe section into threaded engagement with said drill string to substantially said given torque, thereby said jaws grip said drill pipe section so that rotation of the lever arm of said tongs is enabled for setting a final make-up torque of said drill pipe section with said drill string.

2. The improvement according to claim 1, including fluid power means for operating said spinner, said automatic shifting means comprising cylinder and piston means, means mechanically connecting said cylinder and piston means between said spinner and tongs and means operatively connecting the cylinder of said cylinder and piston means to said fluid power means.

3. The improvement according to claim 1, including fluid power means for operating said spinner, said spinner including a housing, first and second spinner jaws pivotally connected to said housing for gripping and spinning said drill pipe section, said first and second jaws being pivotable between an open and a closed position, a respective cylinder and piston means connected between said housing and said first and second jaws, respectively, for pivoting said first and second jaws between said open and closed positions and means operatively connecting the cylinders of said cylinder and piston means to said fluid power means.

4. The improvement according to claim 1, including fluid power means for operating said spinner, said spinner including first and second pivotable spinner jaws, said spinner jaws each including a pair of sprocket wheels, first and second endless chains each trained about a respective pair of sprocket wheels, said fluid power means including a motor having a power take-off shaft and drive means interconnecting said shaft to at least one sprocket wheel of each sprocket wheel pair.

5. The improvement according to claim 1, further including means operatively connected to said automatic shifting means for automatically returning said jaws to said latched position from said gripping position.

6. The improvement according to claim 1, including fluid power means for operating said spinner with a pressurized fluid to spin said drill pipe section, said automatic shifting means including a cylinder and piston connected between said spinner and tongs, said cylinder being operatively connected to said fluid power means via a pressurized fluid conduit, fluid pressure regulation valve means connected in said conduit for admitting pressurized fluid to said cylinder on one side of said piston to urge said piston in a first direction when the pressurized fluid in said conduit upstream of said regulation valve means attains a predetermined pressure, said predetermined pressure substantially corresponding to said given torque.

7. The improvement according to claim 6, wherein movement of said piston in said first direction is operative to shift the jaws of said tongs from said latched position to said gripping position.

8. The improvement according to claim 7, including means operatively connected to said automatic shifting means for automatically returning said jaws to said latched position from said gripping position.

9. The improvement according to claim 8, wherein said returning means includes means biasing said piston in a second direction opposite said first direction, relief valve means having a normally closed position and an open position and connected to said cylinder on said one side of said piston for relieving the pressure on said one side and means actuated by movement of said piston in said first direction for opening said relief valve and in said second direction for closing said valve.

10. The improvement according to claim 1, wherein said drill pipe tongs comprise break-out tongs and including a reversible hydraulic motor for operating said spinner in a direction to spin a section of drill pipe out of threaded engagement with a drill section.

11. In a power-operated spinner for making-up or breaking-out sections of drill pipe, said spinner including a housing, first and second pipe gripping jaws pivotally mounted to said housing, power means coupled to said jaws for operating said spinner and for pivoting said jaws between an open, pipe-receiving position and a closed, pipe-gripping position, said power means further including a motor, sprockets rotatably mounted to said jaws, pipe gripping chain means trained about said sprockets and driven by said motor for gripping said drill pipe when said jaws are closed, the improvement wherein said gripping chain means comprise first and second endless chains trained about the sprockets of said first and second jaws, respectively, and a drive element drivingly connected between said motor and at least one sprocket of each of said jaws, each jaw including two spaced, fixed sprockets comprising an idler sprocket and a driven sprocket defining an endless path of travel such that, when said jaws are pivoted to said closed position, said endless chains grip two spaced peripheral areas of said drill pipe on opposed sides thereof.

12. The improvement according to claim 11, wherein said motor includes a drive shaft and a drive sprocket, said drive shaft being arranged substantially parallel to the axes of said driven sprockets of the jaws and spaced therefrom, the axes of said drive and driven sprockets forming respective apices of a triangle in a plane at right angles to said axes, said drive element comprising a chain trained about said drive sprocket and the driven sprockets of said jaws.

13. The improvement according to claim 11, wherein in the closed position of said jaws, said endless chains are in non-gripping relation with two substantially opposite peripheral portions of said drill pipe.

14. The improvement according to claim 11 wherein said power means includes a reversible hydraulic motor, a hydraulic pump arranged remotely of said spinner for supplying hydraulic fluid to said motor, quick disconnect means for releasably and operatively connecting said hydraulic pump to said hydraulic motor and first and second hydraulic rams operatively connected between said housing and said first and second jaws, respectively.

15. The improvement according to claim 11, wherein said endless gripping chains comprise silent chains.

* * * * *